US005457752A

United States Patent [19]

Engdahl et al.

[11] Patent Number: 5,457,752

[45] Date of Patent: Oct. 10, 1995

[54] DRIVE SYSTEM FOR ACOUSTIC DEVICES

[75] Inventors: Göran Engdahl, Täby; Jan Hidman, Västerås; Gunnar Molund, Västerås; Rune Tenghamn, Västerås, all of Sweden

[73] Assignee: ABB Atom AB, Västerås, Sweden

[21] Appl. No.: 182,008

[22] PCT Filed: Aug. 24, 1992

[86] PCT No.: PCT/SE92/00577

§ 371 Date: Jan. 14, 1994

§ 102(e) Date: Jan. 14, 1994

[87] PCT Pub. No.: WO93/05624

PCT Pub. Date: Mar. 18, 1993

[30] Foreign Application Priority Data

Aug. 29, 1991 [SE] Sweden ..... 9102474

[51] Int. Cl.[6] ..... H04R 25/00

[52] U.S. Cl. ..... 381/190; 381/199; 381/188; 381/205

[58] Field of Search ..... 381/190, 199, 381/205, 188; 335/278, 296, 297, 298, 299, 302, 306

[56] References Cited

U.S. PATENT DOCUMENTS 4,438,509 3/1984 Butler et al. .
4,901,293 2/1990 Kuhn .
4,914,412 4/1990 Engdahl et al. .
5,101,384 3/1992 Tenghamn et al. .

OTHER PUBLICATIONS

Greenlaw et al., "Sonar Transducer Design Incorporates Rare Earth Alloy" in *Defense Systems Review,* Nov. 1984, pp. 50–55.

*Primary Examiner*—Wing F. Chan
*Assistant Examiner*—Sinh Tran
*Attorney, Agent, or Firm*—Watson, Cole, Grindle & Watson

[57] ABSTRACT

A drive system for acoustic devices comprising drive devices, the projecting driving studs (14,15) of which are connected to pressure beams (27,28) of the acoustic device, the drive devices comprising a fixture frame (26) inside of which there are located drive units with an intermediate mechanical prestress device (22,23,24,25), the drive units comprising stator and drive cells stacked by means of guide rings (4,5) and guide discs (11), the stator cell comprising a magnetizing coil (1) with a surrounding tube (2) of soft-magnetic material fixed inside a fixture tube (3), and the drive cell comprising a cylindrical magnetic pellet (6), discs of soft-magnetic material (7,8) and of permanent-magnetic material (9,10) making contact with said magnetic pellet.

4 Claims, 3 Drawing Sheets

DRIVE SYSTEM FOR ACOUSTIC DEVICES

TECHNICAL FIELD

The invention relates to a mechanical drive system for use, inter alia, in acoustic devices. Current acoustic devices are able to operate as transmitters, i.e. as transducers for acoustic signals, and as receivers of acoustic signals. An acoustic device in which the invention may be used to great advantage is as a so-called Sonar, that is, a transmitter which sends out sound waves under water which, after reflection, can be monitored by hydrophones of various kinds.

BACKGROUND ART, THE PROBLEM

It is a well-known fact that low-frequency sound waves can travel longer distances through water than can high-frequency sound waves. For a long time there has also been a considerable need of powerful low-frequency sound transmitters which are capable of working under water, both from a military point of view and from the point of view of the offshore oil and gas industry. Transmitters of various designs and embodiments for these purposes and fields of use have been available on the market for quite a long time. A summary of such acoustic transmitters is given in an article in DEFENSE SYSTEM REVIEW, November 1984, pages 50–55, entitled "Sonar transducer design incorporates rare earth alloy".

Most acoustic transmitters which are used at present are based on either the piezoelectric effect or on magnetostriction. As is well-known, the piezoelectric effect means that a crystalline substance is subjected to a change in shape when an electric voltage is applied to its end surfaces and that a voltage is obtained when the substance is subjected to a physical deformation, respectively. Magnetostriction means that a magnetic material which is subjected to a change of the magnetic flux suffers a change in shape and that an externally caused change in length gives rise to a change in the magnetic flux, respectively. This means that a transmitter which utilizes these effects can also, in principle, be used as a receiver.

A variety of different embodiments of acoustic transmitters exist. In low-frequency applications it is common that they have a cylindrical shape with either a circular or elliptical cross section area.

The greatest problem with this type of transmitters is to achieve a sufficiently great amplitude of the oscillations. To this end, either a large transmitter area or a small transmitter area with great amplitude of oscillation would be required.

The introduction of the so-called giant magnetostrictive materials has improved the conditions for obtaining good acoustic transmitters. With such materials as driving elements, amplitude changes may be obtained which largely amount to 30 times the corresponding changes using piezoelectric materials. Transmitters which utilize these giant magnetostrictive materials have existed for several years. One property of transmitters which utilize giant magnetostrictive materials is that they must be mechanically prestressed. This can be done in different ways, for example as shown in U.S. Pat. No. 4,438,509 with the aid of prestressed wires.

A frequently occurring embodiment for the actual driving will be described in greater detail starting from a cylindrical transmitter with a near elliptical cross section. The cylindrical envelope surface consists of an elastic diaphragm or shell. Inside and parallel to the axis of the cylinder and making contact with the shell are two beams applying pressure to the shell. The cross sectional area of the beams is symmetrically mirror-inverted in relation to the minor axis of the elliptical shell and each beam is delimited by that part of the shell which faces the end of the major axis and a chord parallel to the minor axis. Between the beams and making contact with their plane-parallel sides there is arranged an electrically-controlled driving element in the form of a driving rod. The longitudinal axis of the driving rod coincides with the major axis of the elliptically-formed cross section and lies midway between the end surfaces of the transmitter. In those case where the magnetostrictive effect is utilized, the driving rod consists of a magnetostrictive material which with a surrounding winding is magnetized to keep pace with the desired frequency of the transmitter. If the piezoelectric effect is to be utilized, the driving rod consists of a piezoelectric material. The driving rod may, of course, consist in its entirety, or in certain parts, of a material with the desired possibilities of changing the length.

The fundamental embodiment of an acoustic transmitter described above may be different as regards the actual details. An acoustic transmitter with a cylindrical shape and with an elliptical cross section area and with driving rods of a giant magnetostrictive material is disclosed, inter alia, in U.S. Pat. No. 4,901,293 entitled "A rare earth flextensional transducer".

Swedish patent 8901905-3, "Device in acoustic transmitters", also describes a cylindrical transmitter with elliptical cross section. The driving element here consists of a body with oppositely located recesses into which driving rods are inserted. The driving rods, in turn, are fixed into pressure rods which in the same way as above influence the diaphragm.

Swedish patent application 9003086-7 describes a drive package for acoustic transmitters comprising a frame of magnetic material with windows for mounting driving members and prestress devices. Two windows with driving members and an intermediate window with a mechanical prestress device form a column which, by means of pressure studs in the driving members and holes in the frame, prestress pressure beams, located inside the transmitter, in the shell of the transmitter. The drive package may comprise several columns.

The building system embraced by the invention comprises magnetic circuits for magnetization of the active material in accordance with U.S. Pat. No. 4,914,412, "Magnetic circuit". The magnetic circuits included are intended to magnetize cylindrically shaped pellets of magnetostrictive material, in the axial direction in accordance with the U.S. patent. This magnetic circuit comprises a magnetizing coil, disc-shaped permanent magnets for bias magnetization and discs of soft-magnetic material which have a diameter corresponding to the outside diameter of the coil as well as a soft-magnetic cylindrical tube which surrounds the magnetizing coil. The soft-magnetic parts are included in the magnetic circuits which comprise the magnetostrictive pellets.

SUMMARY OF THE INVENTION

The drive system for an acoustic device according to the invention comprises a number of drive devices placed in parallel and symmetrically between the pressure beams which, according to the state of the art, are included in these devices. The drive devices comprise a fixture frame inside of which there are two drive units with an intermediate mechanical prestress device. The drive devices have axially extending studs which make contact with the opposite pressure beams included in the acoustic device.

The drive units, in their turn, comprise an optional number of driving elements stacked in a row. Each driving element consists of a stator cell, drive cell and guide device in the form of guide rings and a hollow guide disc, which together, among other things, realize magnetic circuits in accordance with U.S. Pat. No. 4,914,412.

Each one of the above-mentioned parts included in the drive system will be given a short summary description. A stator cell consists of the above-mentioned magnetizing coil which is fixed to a surrounding soft-magnetic cylindrical tube according to the above, the tube, in turn, being fixed to a similarly cylindrical tube, hereafter called a fixture tube, of non-magnetic material. As will become clear from the detailed description of the preferred embodiments, the soft-magnetic tube has an axial length which is somewhat greater than the axial length of the coil and the fixture tube a still somewhat greater axial length.

A drive cell according to the invention comprises the above-mentioned cylindrically-shaped magnetostrictive pellet as well as the above-mentioned soft-magnetic discs concentrically connected to the two circular end surfaces of the pellet and, making contact with each one of these, the discs of permanent-magnetic material. All of these discs have a outside diameter corresponding to the outside diameter of the coil.

For centering and radial guiding of the discs inside the stator cells and for stacking the fixture tubes, these tubes are turned out for the guide rings at the annular end surfaces. For centering and radial guiding of the magnetostrictive pellet, there has been applied, on one side of one of the soft-magnetic discs facing the pellet, a thin holed guide disc with an outside diameter equal to that of the discs and with an inside diameter insignificantly larger than the diameter of the pellet.

When stacking the driving elements into a drive unit, the stator cells will have a common axial centre line via the guide rings. In this way, the drive cells will also be stacked and form a drive cell package with a common pemanent-magnetic disc and a guide ring between each drive cell. The play between the pellets and the holed guide discs is so large that the movable stack becomes completely parallel to the stator cell stack in spite of the fact that there is no complete parallelism between the contact surfaces included in the movable stack. The function of the guide rings used is, inter alia, to achieve parallelism between the stator cell stack and the movable stack during the mounting and to ensure that these stacks become freely movable in the axial direction.

By stacking a suitable number of driving elements on top of each other, drive units with different lengths may be composed.

In order for the drive unit to function in the intended way, it must be mechanically prestressed, as is also clear from the above description of the background art. According to the invention, this is achieved by mounting two drive units with an intermediate mechanical prestress device inside a fixture frame. The frame with drive units and prestress device forms a drive device, which per se constitutes a building element which, in addition to being used in acoustic devices, can also be generally used as a force- and movement-imparting device for other applications.

As described above, the drive system comprises a number of parallel drive devices, the axial length and number of which are determined by the dimensions of the surrounding casing and by the force and movement which are required in each particular case. By providing the fixture frames of the drive devices with devices for fixing the frames to each other, the drive devices can be mounted together to form a complete drive system consisting of the desired number of drive devices. Fixture plates can also be mounted on the drive devices, and on these fixture plates any auxiliary equipment may be placed.

Acoustic devices according to the invention have an efficiency outside the resonance frequency range which is normally lower than 50%. This means that, in continuous operation, the parts included have to be cooled. Cooling of the drive system according to the invention may suitably be performed by providing the external rings of the stator cells with cooling channels or cooling flanges. In the patent application entitled "Cooling system for acoustic devices", filed concurrently with this application, a cooling system with cooling channels in the stator cells is described.

DESCRIPTION OF THE PREFERRED EMBODIMENTS

Figure 1:
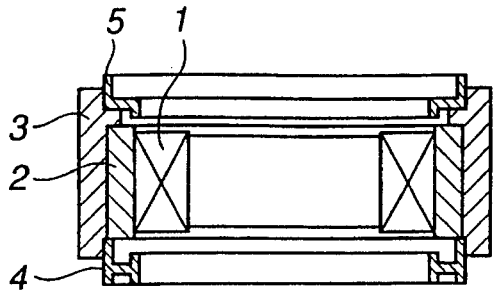
FIG. 1 shows a stator cell with guide rings.

FIG. 1 shows a stator cell with guide rings. The stator cell comprises a magnetizing coil 1 fixed to a soft-magnetic tube 2 which in turn is fixed to a fixture tube 3. In the end surfaces of the fixture tubes, slots for the guide rings 4 and 5 have been made. As is clear from the figure, the guide rings are of somewhat different design and the explanation of this will be given below.

Figure 2:
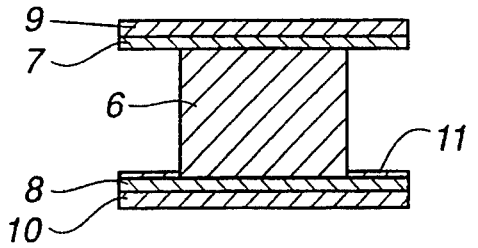
FIG. 2 shows a drive cell with a holed guide disc.

FIG. 2 shows the composition of a drive cell with an associated guide disc. It comprises a cylindrically-shaped magnetic pellet 6 with discs 7 and 8 of soft-magnetic material making contact with the two end surfaces of the pellet. Permanent-magnetic discs 9 and 10 make direct contact with the discs 7 and 8. The diameters of the discs largely correspond to the outside diameter of the magnetizing coil. For radially guiding the pellet, a thin holed guide disc 11 of a suitable plastic material is provided on that side of the soft-magnetic disc 8 which faces the pellet, the guide disc having the same outside diameter as the discs and having an inside diameter insignificantly greater than the diameter of the pellet.

Figure 3:
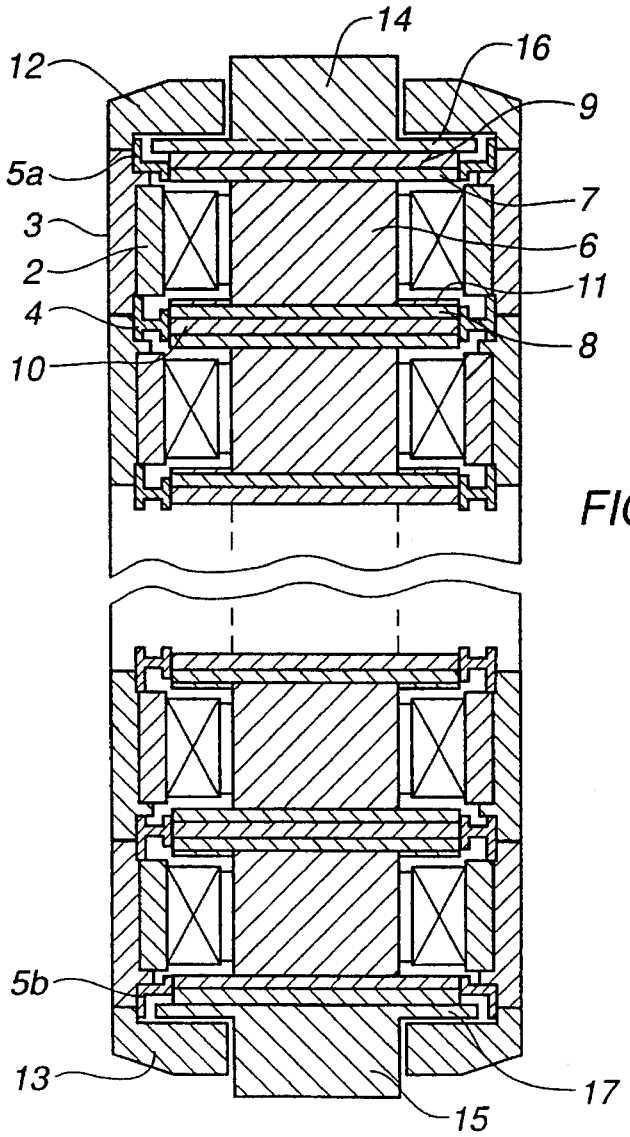
FIG. 3 shows the composition of a drive unit.

FIG. 3 shows a drive unit composed of an optional number of stacked stator cells and a corresponding number of drive cells. As the figure shows, the stacked drive cells form a drive cell package with a common permanent-magnetic disc between each drive cell. Towards the external stator cells of the drive unit, edge rings 12 and 13 are connected. The outwardly-facing surface of these rings may be in the form of a frustum of a cone. As is shown, the guide rings **5*a* and 5*b* for centering the edge rings are shaped somewhat differently from the guide rings 4 between the stator cells since the guide rings 5*a* and 5*b* only need to center one soft-magnetic and one permanent-magnetic disc. A suitable material for the guide rings is copper which provides a certain lubricating effect in operation while at the same time its good thermal conductivity makes possible a good transport of heat out to the fixture tubes. The output of force and movement of the drive unit is performed at the two driving rods 14 and 15 which, towards the permanent-magnetic discs of the external drive cells, are shaped as discs 16 and 17**.

Figure 4:
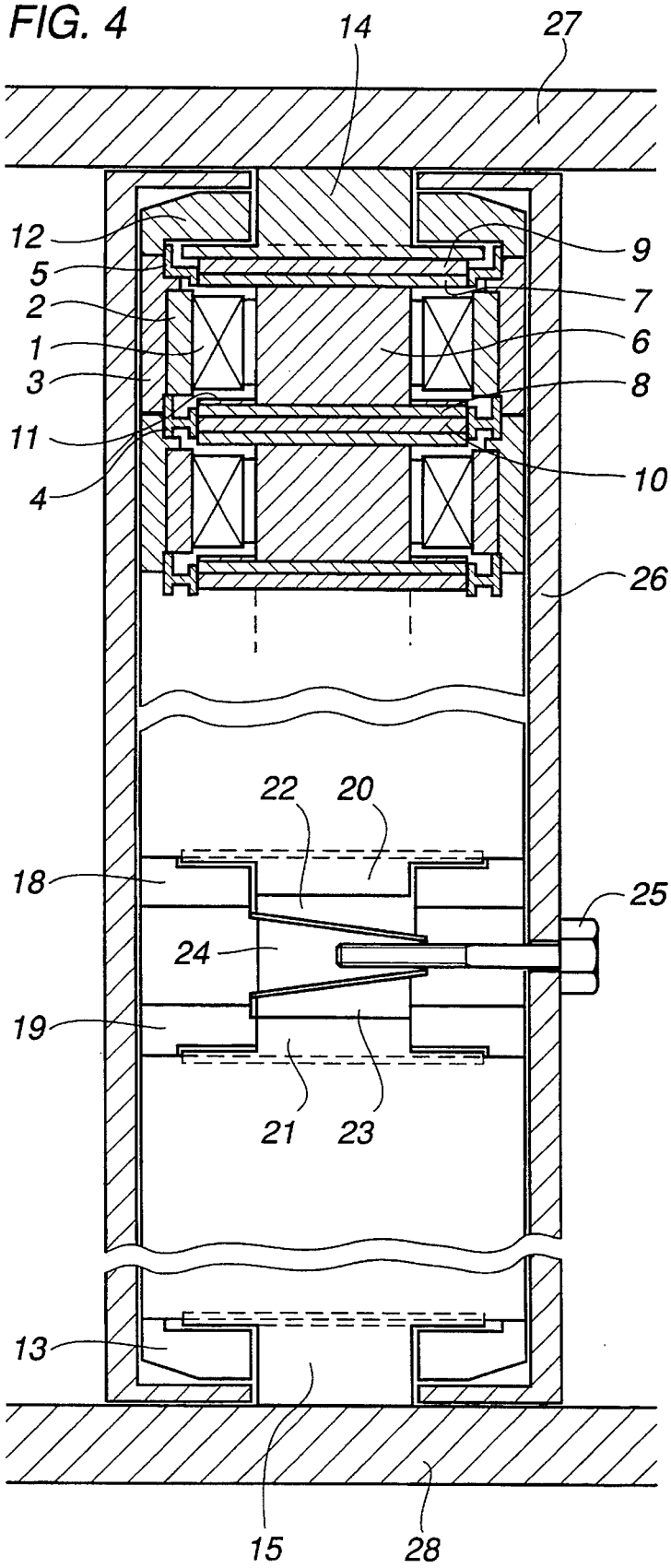
FIG. 4 shows how a drive device is built up.

A driving element according to FIG. 3 can be mechanically prestressed in a plurality of different ways, for example as stated in the above-mentioned U.S. Pat. No. 4,438,509. However, a preferred embodiment of the invention is shown in FIG. 4 which constitutes a so-called drive device. The drive device comprises two drive units which are practically identical with the drive unit in FIG. 3 and with an intermediate wedge-shaped mechanical prestress device. The difference between the drive units is that the edge rings which are facing the prestress device have been replaced by the parallelepipeds 18 and 19. The drive studs 20 and 21 facing the prestress device may also be somewhat adjusted in the axial length to adapt to the dimensions of the parallelepipeds.

Recesses for two lugs 22 and 23 with confronting plane surfaces, making an angle equal to the wedge angle of a prestress wedge 24 placed between the lugs, have been provided in the parallelepipeds. A hole for a prestress screw 25 is threaded in the wedge. The drive studs 20 and 21 make contact with the intermediate prestress device, which is fixed to a fixture frame 26. The drive studs 14 and 15 extending from the drive device make contact with the two pressure beams 27 and 28 of the acoustic device.

The fixture frame is of ferromagnetic material and constitutes an integral part of the magnetic circuit which closes the magnetic flux emanating from the discs of permanent-magnetic material located at the two outer ends of the drive device.

Figure 5:
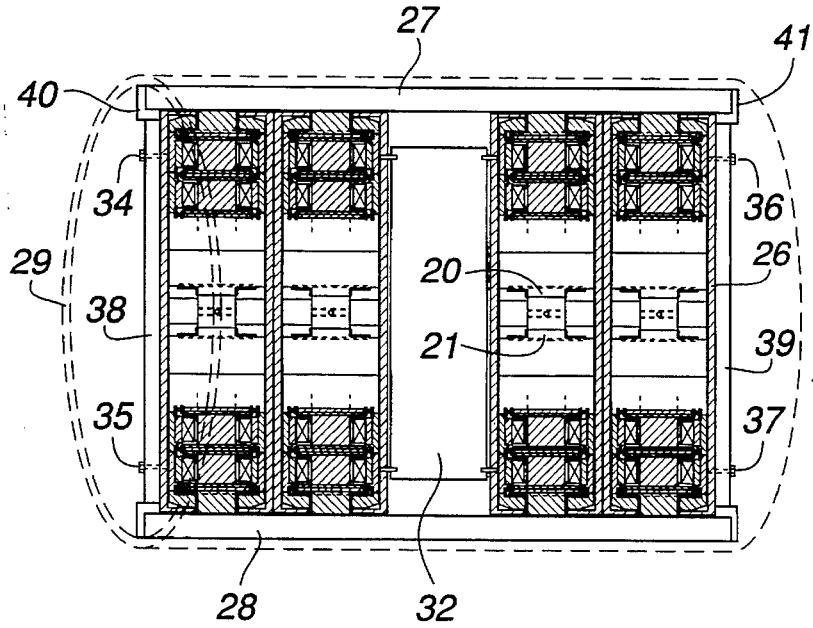
FIGS. 5 and 6 show the composition of a drive system and how it may be built into an acoustic device.
Figure 6:
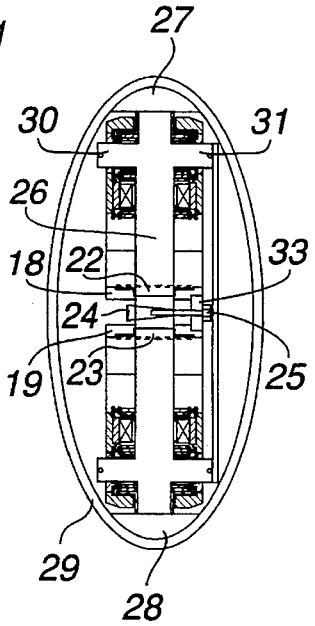

In two views perpendicular to each other, FIGS. 5 and 6 show how a drive system according to the invention may be built up in a preferred embodiment and how, shown in dashed lines, it may be built into an acoustic device of cylindrical shape with a near elliptical cross section. The shell of the acoustic device is shown at 29. In this embodiment the drive system comprises four drive devices which are directly screwed together two-by-two via extending arms 30 and 31 on the fixture frames. These directly screwed-together drive devices are also screwed together by means of spacing yokes in such a way as to form an intermediate space for electric control means, etc. These control means are suitably mounted on a fixture plate as shown at 32. As is clear, the prestress mechanism in the drive devices according to FIGS. 3 and 4 has been rotated through 90 degrees in relation to the prestress mechanism in FIG. 5. The counter support for the prestress screw 25 now consists of an element 33 fixed between the parallelepipeds 18 and 19. In a preferred embodiment, the heads of the prestress screws are shaped as worm screws, which can all be operated by worm screw rods extending towards one of the end plates.

The outer drive devices are fixed by screws 34, 35, 36 and 37 to the respective end plates 38 and 39 of the acoustic device. The movability and sealing of the shell are ensured by means of the elastic rings 40 and 41 provided around the end plates.

A drive system according to the invention is not limited only to the preferred embodiment shown in the accompanying figures. Thus, for example, the drive unit may consist of anything from one to several driving elements. Similarly, the drive device may also comprise anything from one to several drive units. In a drive device comprising only one drive unit, one of the parts of the prestress mechanism will make contact with the fixture frame and one of the driving rods will extend from the prestress mechanism. The drive system may, of course, also comprise only one drive device.

We claim:

1. A drive system for an acoustic device, said acoustic drive device having a cylindrical elastic shell and diametrically opposed pressure beams positioned within and in contact with said shell, said drive system being positionable between said opposed pressure beams and capable of moving the shell in an oscillating motion, said drive system comprising a drive device which includes:

an elongated hollow frame defining opposite ends with openings therein, first and second drive rods respectively positioned within said frame at said opposite ends thereof and providing portions which extend through the openings in the respective ends of said frame so as to contact and oscillate said pressure beams, a mechanical prestress key joint means positioned within said frame between said first and second drive rods, and a drive assembly operating as a magnetic circuit positioned within said frame between said first and second drive rods in stacked relation to said mechanical prestress means, said drive assembly comprising:

a stator cell including a magnetizing coil, a first tube of soft magnetic material surrounding said coil, a second tube of non-magnetic material surrounding said first tube, and guide rings at opposite ends of said stator cell, and a drive cell including a cylindrical magnetic pellet which extends through said magnetizing coil of said stator cell, first and second discs of soft magnetic material respectively in contact with opposite ends of said pellet, third and fourth discs of permanent magnetic material respectively in contact with said first and second discs, and a disc guide for radially guiding the pellet, oscillating current supplied to said magnetizing coil causing an oscillating motion of said drive rods and thus said pressure beams and said acoustic device.

2. A drive system for an acoustic device according to claim 1, comprising four said drive devices and wherein each drive device comprises two pair of stacked drive assemblies separated by a said mechanical prestress key joint means.

3. A drive system for an acoustic device according to claim 1, wherein said drive device comprises at least four stacked stator cells and drive cells.

4. A drive system for an acoustic device according to claim 1, wherein said key joint means comprises a wedge defining two plane surfaces extending at a wedge angle relative to one another, two lugs with plane surfaces which contact the respective plane surfaces of said wedge, and a screw for pulling the wedge relative to the two lugs such that the two lugs will move apart to create mechanical prestress in the magnetic pellet.

* * * * *